US009693588B2

(12) United States Patent
Zhu

(10) Patent No.: US 9,693,588 B2
(45) Date of Patent: Jul. 4, 2017

(54) HEATING ELEMENTS FOR ELECTRONIC CIGARETTES

(71) Applicant: Xiaochun Zhu, Guangdong (CN)

(72) Inventor: Xiaochun Zhu, Guangdong (CN)

( * ) Notice: Subject to any disclaimer, the term of this patent is extended or adjusted under 35 U.S.C. 154(b) by 253 days.

(21) Appl. No.: 14/464,311

(22) Filed: Aug. 20, 2014

(65) Prior Publication Data

US 2016/0000146 A1 Jan. 7, 2016

Related U.S. Application Data

(63) Continuation of application No. PCT/CN2014/081343, filed on Jul. 1, 2014.

(51) Int. Cl.
*H05B 3/44* (2006.01)
*A24F 47/00* (2006.01)

(52) U.S. Cl.
CPC ..... *A24F 47/008* (2013.01); *H05B 3/44* (2013.01); *H05B 2203/014* (2013.01); *H05B 2203/016* (2013.01); *H05B 2203/021* (2013.01); *H05B 2203/022* (2013.01)

(58) Field of Classification Search
CPC ... A24F 47/008; H05B 3/44; H05B 2203/014; H05B 2203/016; H05B 2203/021; H05B 2203/022
See application file for complete search history.

(56) References Cited

U.S. PATENT DOCUMENTS 5,878,752 A * 3/1999 Adams ..... A24F 47/008 131/194
2011/0277757 A1 11/2011 Terry et al.
2013/0319407 A1* 12/2013 Liu ..... A61M 15/06 128/202.21
2014/0209105 A1* 7/2014 Sears ..... F22B 1/28 131/328

FOREIGN PATENT DOCUMENTS

| | | | |
|---|---|---|---|
| CN | 103876289 | A | 6/2014 |
| CN | 203662025 | U | 6/2014 |
| CN | 104068476 | A | 10/2014 |
| CN | 203969206 | U | 12/2014 |

OTHER PUBLICATIONS

International Search Report, Apr. 1, 2015.

* cited by examiner

*Primary Examiner* — Brian Jennison
(74) *Attorney, Agent, or Firm* — Locke Lord LLP; Tim Tingkang Xia, Esq.

(57) ABSTRACT

The present invention relates to a heating element assembly for e-cigarette. The heating element assembly includes a cylindrical ceramic e-liquid conduit to store e-liquid, at least one heating wire wound on the inside of ceramic e-liquid conduit, a base, and a cylinder on top of base. The ceramic wall around the ceramic e-liquid conduit forms a vapor path with an air intake at bottom and an air exhaust on top. The cylinder sits on the base to form a main cavity 300 that houses the ceramic e-liquid conduit. The cylinder has an e-liquid intake to receive e-liquid from an e-liquid storage. The e-liquid enters the ceramic e-liquid conduit through e-liquid intake, and the e-liquid is heated by the heating wire to generate vapor, and the generated vapor goes up through the air intake, the air exhaust, to exit the heating element assembly from the upper end of the vapor path.

20 Claims, 4 Drawing Sheets

HEATING ELEMENTS FOR ELECTRONIC CIGARETTES

CROSS-REFERENCE TO RELATED APPLICATIONS

This application is a continuation of International Patent Application No. PCT/CN2014/081343, filed with the State Intellectual Property Office of China on Jul. 1, 2014, entitled "Heating Elements for Electronic Cigarettes", by Xiaochun ZHU, the disclosures of which are incorporated herein in their entireties by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD

The present invention mainly relates to the field of electronic cigarette (or e-cigarette), and more particularly to several ceramic heating elements for electronic cigarettes.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

Nicotine is a potent parasympathomimetic alkaloid with low molecular weight and short half-life in blood. In small doses, nicotine acts as a stimulant. This stimulant effect causes many smokers to form dependency on tobacco smoking However, the major harmful ingredient of tobacco is not the nicotine, but tar. Tar is the common name for the resinous, partially combusted particulate matter produced by the burning of tobacco in the act of smoking. Tar is toxic and damages the smoker's lungs over time through various biochemical and mechanical processes. Tar also damages the mouth by rotting and blackening teeth, damaging gums, and desensitizing taste buds.

It is therefore desirable to have an electronic cigarette (or e-cigarette) that delivers the nicotine without toxic tar. The electronic cigarette is sometimes referred as electronic vaporing device, personal vaporizer (PV), or electronic nicotine delivery system (ENDS). It is a battery-powered device which simulates tobacco smoking It generally uses a heating element that vaporizes a liquid solution. Some solutions contain a mixture of nicotine and flavorings, while others release a flavored vapor without nicotine. Many are designed to simulate smoking implements, such as cigarettes or cigars, in their use and/or appearance, while others are considerably different in appearance.

Conventionally, the liquid solution in the electronic cigarette is stored in a liquid supplying reservoir. The liquid supplying reservoir contains various types of fibers such as cotton, polypropylene fiber, terylene fiber, or nylon filer. The liquid solution is soaked in these fibers and the liquid solution is passed through these fibers to a heating element to be vaporized. The liquid solution is vaporized on the heating element with fibers. However, the poor contact of the fibers with heating element causes uneven vaporization. Additionally the direct contact of the fiber with heating element also causes a burning smell. It is desirable to allow liquid solution to make direct contact with the heating element without any fibers such that the liquid solution is vaporized evenly without the burning smell.

The e-liquid usually contains three basic elements: nicotine, flavor concentrate, and diluents. The flavor concentrate provides the electronic cigarettes various flavors to meet the smokers' desires. With traditional fiber based e-liquid storage, once one flavor concentrate is used, it is very difficult to remove the residue of the flavor concentrate used. For example, if an orange flavored concentrate is used in an electronic cigarette, one has to remove the fibers in the storage to completely removed residue of the orange flavored concentrate, to clean the e-liquid storage, to replace the fiber in the storage and to add a new flavor concentrate to switch to the new flavor concentrate. It is desirable to have a e-liquid storage without fiber inside, and once the e-liquid is used up, the e-liquid is completed evaporated without any residue of the previous flavor concentrate.

Therefore, heretofore unaddressed needs exist in the art to address the aforementioned deficiencies and inadequacies.

SUMMARY

In one aspect, the present invention relates to a heating element assembly for an e-cigarette. In certain embodiments, the heating element assembly has: a ceramic e-liquid conduit, at least one heating wire, a base, and a cylinder. The ceramic e-liquid conduit is in cylindrical shape with a ceramic wall around to store e-liquid. The ceramic wall around the ceramic e-liquid conduit forms a vapor path. The vapor path has an air intake at a lower end of the vapor path and an air exhaust at an upper end of the vapor path. The heating wire is wound on and around the internal ceramic wall of the ceramic e-liquid conduit. The base has an upper end and a lower end. The cylinder sits on the upper end of the base to form a main cavity. The main cavity houses the ceramic e-liquid conduit. The cylinder has an e-liquid intake on the side wall of the cylinder to allow e-liquid to flow from an e-liquid storage to the ceramic e-liquid conduit. In one embodiment, the e-liquid enters the ceramic e-liquid conduit through the e-liquid intake. The e-liquid is then heated by the heating wire to generate vapor. The generated vapor goes up through the air intake, the air exhaust, and exits the heating element assembly from the upper end of the vapor path.

In certain embodiments, the vapor path has several air passages. These air passages connect the air intake to the air exhaust in parallel from the lower end of the vapor path to the upper end of the vapor path. Each of these air passages has a cylindrical opening from the lower end to the upper end of the vapor path. One or more heating wires are wound on each of these air passages and these heating wires are attached to the internal wall of the air passage spirally from the lower end to the upper end of the air passage. In one embodiment, the heating wires for these air passages are connected in serial. In another embodiment, the heating wires for these air passages are connected in parallel.

In certain embodiments, the main cavity has a cylindrical opening in the center. The ceramic e-liquid conduit has a cylindrical opening in the center and is fitted tightly inside of the cylindrical opening of the main cavity. The ceramic e-liquid conduit is sealed with a lower seal at the air intake and an upper seal at the air exhaust. The lower seal has a protruded edge to seal the space between the lower seal and the air intake of the vapor path. The upper seal has a protruded edge to seal the space between the upper seal and the air exhaust of the vapor path. The cylindrical opening between the lower seal and the upper seal forms a first air path.

In certain embodiments, the heating element assembly also has: a cylindrical top cover, a cylindrical plug, and a first seal ring. The cylindrical top cover is placed on the upper seal at the air exhaust. The cylindrical plug is placed on top of the cylindrical top cover. The cylindrical top cover and the cylindrical plug have a center cylindrical opening that forms a second air path. The first seal ring is used to seal a connection between the cylindrical plug of the heating element assembly and the e-cigarette.

In certain embodiments, the axes of the air intake, the air exhaust, and the first air path, and the second air path, and the ceramic e-liquid conduit are coaxial.

In certain embodiments, the heating element assembly also has: a metal cover, an insulation cover, and a metal tube. The metal cover is connected to the lower end of the base and is electrically connected to a first end of the heating wire to form a first electrical terminal to an electrical power supply of the e-cigarette. The insulation cover is placed inside of the metal cover. The metal tube is placed inside of the insulation cover and is electrically connected to a second end of the heating wire to form a second electrical terminal to the electrical power supply of the e-cigarette. The metal cover and the metal tube are insulated by the insulation cover. The first electrical terminal and the second electrical terminal are connected to the positive terminal and negative terminal of the electrical power supply of the e-cigarette, respectively.

In another aspect, the present invention relates to an e-cigarette. In certain embodiments, the e-cigarette includes a heating element assembly. The heating element assembly includes: a ceramic e-liquid conduit, at least one heating wire, a base, and a cylinder. The ceramic e-liquid conduit is in cylindrical shape with a ceramic wall around to store e-liquid. The ceramic wall around the ceramic e-liquid conduit forms a vapor path. The vapor path has an air intake at a lower end of the vapor path and an air exhaust at an upper end of the vapor path. The heating wire is wound on and around the internal ceramic wall of the ceramic e-liquid conduit. The base has an upper end and a lower end. The cylinder sits on the upper end of the base to form a main cavity. The main cavity houses the ceramic e-liquid conduit. The cylinder has an e-liquid intake on the side wall of the cylinder to allow e-liquid to flow from an e-liquid storage to the ceramic e-liquid conduit. In one embodiment, the e-liquid enters the ceramic e-liquid conduit through the e-liquid intake. The e-liquid is then heated by the heating wire to generate vapor. The generated vapor goes up through the air intake, the air exhaust, and exits the heating element assembly from the upper end of the vapor path.

In certain embodiments, the vapor path of the e-cigarette has several air passages. These air passages connect the air intake to the air exhaust in parallel from the lower end of the vapor path to the upper end of the vapor path. Each of these air passages has a cylindrical opening from the lower end to the upper end of the vapor path. One or more heating wires are wound on each of these air passages and these heating wires are attached to the internal wall of the air passage spirally from the lower end to the upper end of the air passage. In one embodiment, the heating wires for these air passages are connected in serial. In another embodiment, the heating wires for these air passages are connected in parallel.

In certain embodiments, the main cavity of the e-cigarette has a cylindrical opening in the center. The ceramic e-liquid conduit has a cylindrical opening in the center and is fitted tightly inside of the cylindrical opening of the main cavity. The ceramic e-liquid conduit is sealed with a lower seal at the air intake and an upper seal at the air exhaust. The lower seal has a protruded edge to seal the space between the lower seal and the air intake of the vapor path. The upper seal has a protruded edge to seal the space between the upper seal and the air exhaust of the vapor path. The cylindrical opening between the lower seal and the upper seal forms a first air path.

In certain embodiments, the heating element assembly of the e-cigarette also has: a cylindrical top cover, a cylindrical plug, and a first seal ring. The cylindrical top cover is placed on the upper seal at the air exhaust. The cylindrical plug is placed on top of the cylindrical top cover. The cylindrical top cover and the cylindrical plug have a center cylindrical opening that forms a second air path. The first seal ring is used to seal a connection between the cylindrical plug of the heating element assembly and the e-cigarette.

In certain embodiments, the axes of the air intake, the air exhaust, and the first air path, and the second air path, and the ceramic e-liquid conduit are coaxial.

In certain embodiments, the heating element assembly of the e-cigarette also has: a metal cover, an insulation cover, and a metal tube. The metal cover is connected to the lower end of the base and is electrically connected to a first end of the heating wire to form a first electrical terminal to an electrical power supply of the e-cigarette. The insulation cover is placed inside of the metal cover. The metal tube is placed inside of the insulation cover and is electrically connected to a second end of the heating wire to form a second electrical terminal to the electrical power supply of the e-cigarette. The metal cover and the metal tube are insulated by the insulation cover. The first electrical terminal and the second electrical terminal are connected to the positive terminal and negative terminal of the electrical power supply of the e-cigarette, respectively.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention, and wherein.

DETAILED DESCRIPTION

Figure 1:
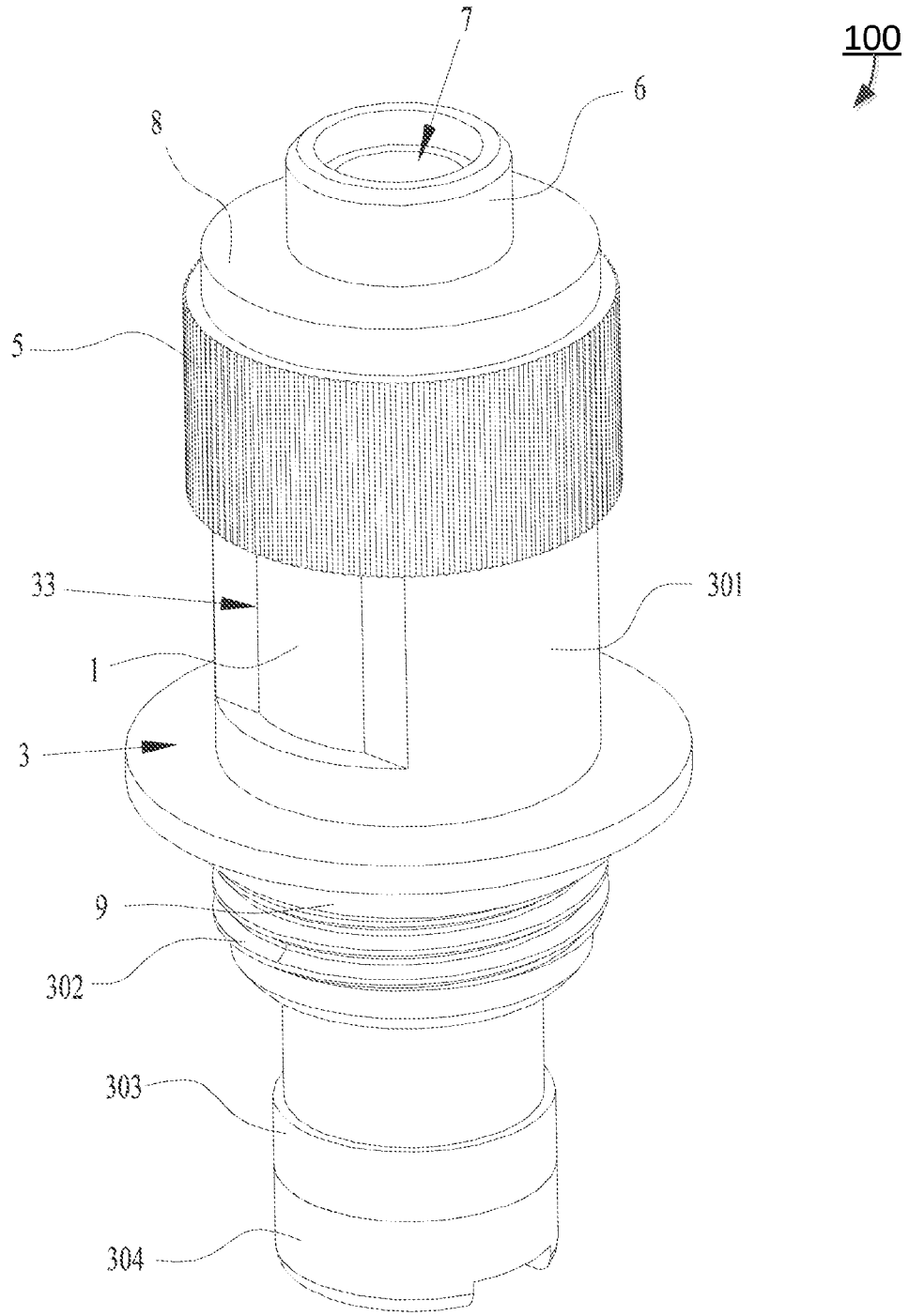
FIG. 1 is a perspective view of an overall structure of a heating element assembly for an electronic cigarette according to one embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

The description will be made as to the embodiments of the present invention in conjunction with the accompanying drawings FIGS. 1 through 4. In accordance with the purposes of this invention, as embodied and broadly described herein, this invention, in one aspect, relates to a ceramic heating element assembly for an electronic cigarette.

Many specific details are provided in the following descriptions to make the present invention be fully understood, but the present invention may also be implemented by using other manners different from those described herein, so that the present invention is not limited by the specific embodiments disclosed in the following.

Figure 2:
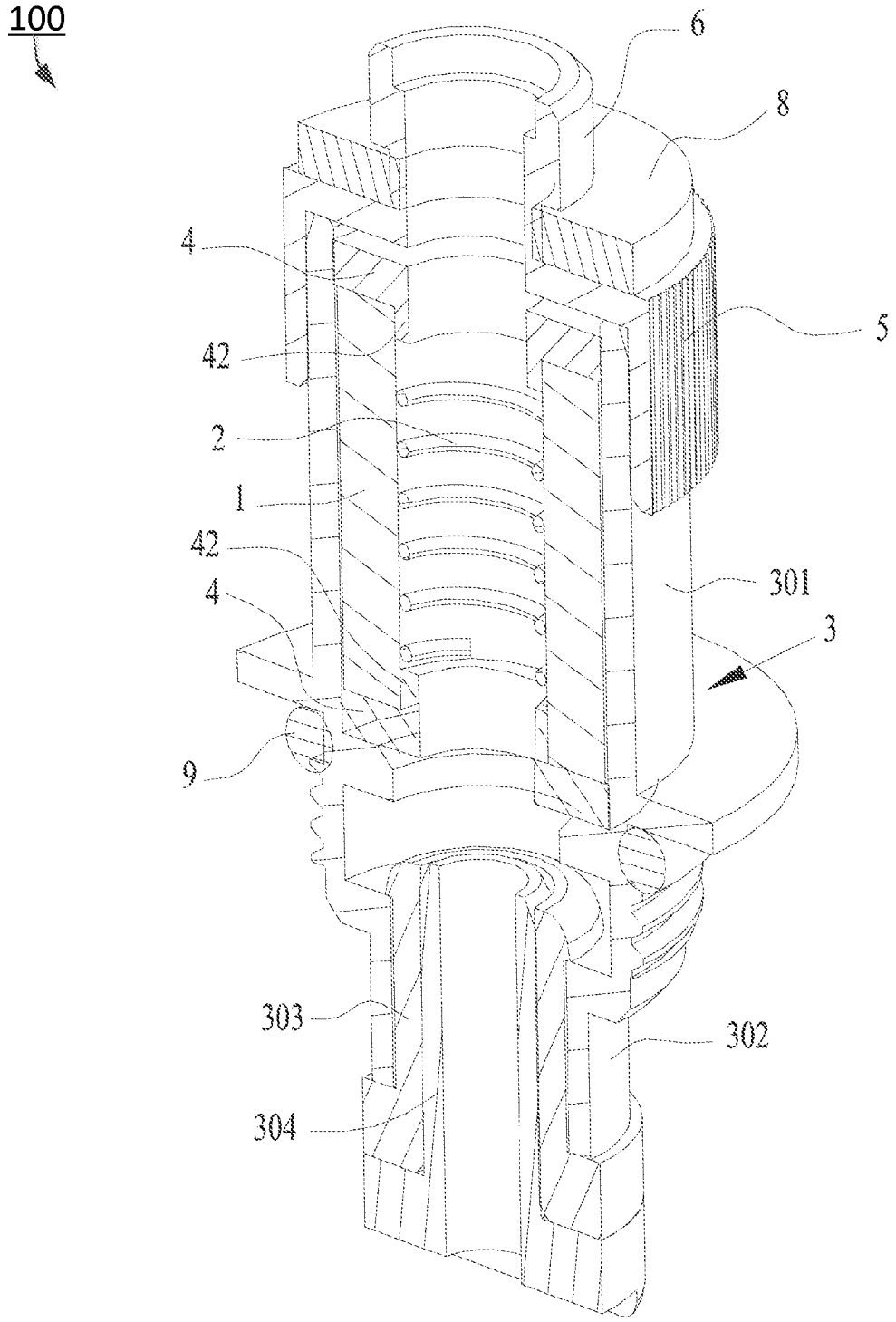
FIG. 2 shows a perspective cross sectional view of the heating element assembly for an electronic cigarette according to one embodiment of the present invention.
Figure 3:
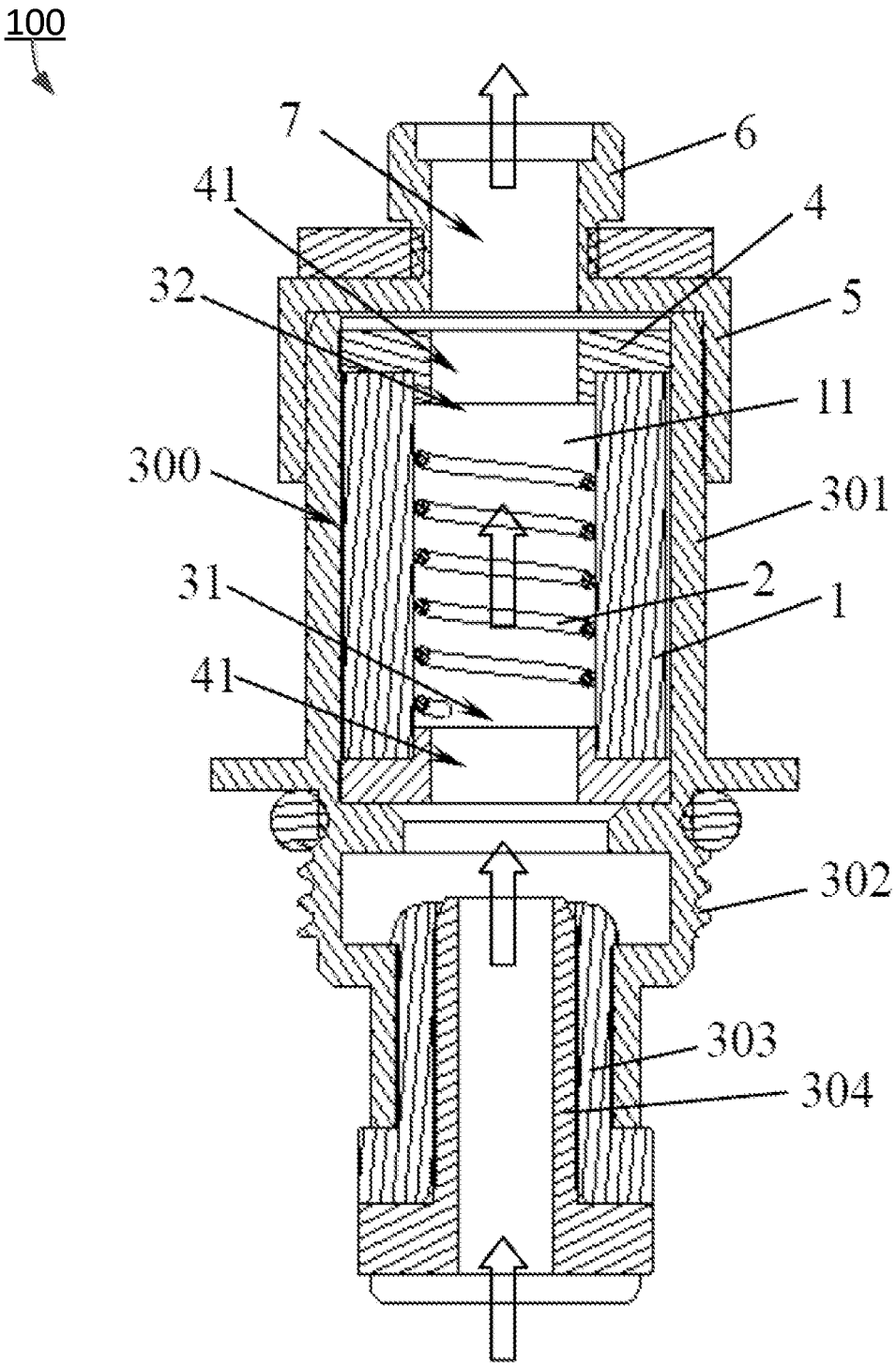
FIG. 3 shows a cross sectional view of the heating element assembly for an electronic cigarette according to one embodiment of the present invention.

Referring now to FIGS. 1-3, a perspective view of an overall structure of a heating element assembly 100 for an electronic cigarette, a perspective cross sectional view of the heating element assembly 100, and a cross sectional view of the heating element assembly 100 are shown according to certain embodiments of the present invention. The heating element assembly 100 includes: (a) a ceramic e-liquid conduit 1, (b) a heating wire 2, and (c) a base 3. The base 3 connects to a cylinder 301 on its upper end, and a metal cover 302 on its lower end. Inside the cylinder 301, the heating element assembly 100 has a main cavity 300 in cylindrical shape where the ceramic e-liquid conduit 1 is placed. The cylinder 301 has a lower end and an upper end. The lower end of the cylinder 301 has an air intake 31, and the upper end of the cylinder 301 has an air exhaust 32. The air intake 31 and the air exhaust 32 corresponds a lower end of the main cavity 300 and an upper end of the main cavity 300, respectively. The main cavity 300 has an e-liquid intake 33 on one side of the cylinder 301, allowing the e-liquid to flow from the e-liquid intake 33 into the main cavity 300. The ceramic e-liquid conduit 1 is also in cylindrical shape and has a vapor path 11 in the center. The vapor path 11 has a lower end that is located at the air intake 31 and an upper end that is located at the air exhaust 32. The heating wire 2 is wound on and around the internal wall of the vapor path 11. The heating wire 2 is electrically connected to the base 3.

In one embodiment, the ceramic e-liquid conduit 1 is porous and e-liquid passes through the e-liquid intake 33, and the e-liquid is saturated on the ceramic e-liquid conduit 1. Once the heating wire 2 is electrically powered by a power source through the base 3, the e-liquid inside the ceramic e-liquid conduit 1 is vaporized through the heat generated by the heating wire 2. As shown in FIG. 3, air enters the main cavity 300 through the air intake 31, combines with the smoke generated by the vaporized e-liquid, and exits the main cavity 300 through the air exhaust 31.

Figure 4:
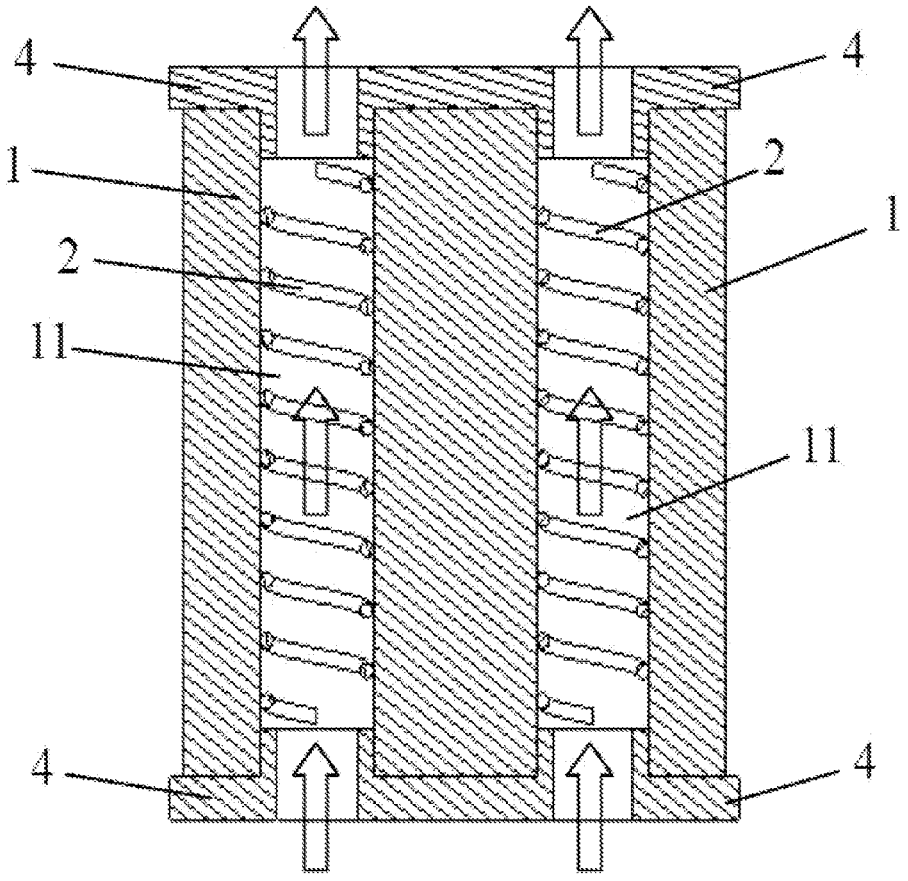
FIG. 4 shows a cross sectional view of a ceramic e-liquid conduit of the heating element assembly for an electronic cigarette according to another embodiment of the present invention.

In one embodiment, the vapor path 11 includes at least one air passage from the air intake 31 to the air exhaust 32. In another embodiment, the vapor path 11 includes two or more individual air passages from the air intake 31 to the air exhaust 32. The FIG. 4 shows a cross sectional view of a ceramic e-liquid conduit 1 having two individual air passages. The ceramic e-liquid conduit 1 having two or more individual air passages increases the amount of vaporization, and speeds up the vaporization process. The air flows through these individual air passages evenly and smoothly.

The vapor path 11 is in cylindrical shape formed by the internal wall of the air passages, and one or more heating wires 2 wound through the one or more air passages from the lower end to the upper end spirally along the internal wall of the air passages as shown in FIG. 4. In one embodiment, the one or more heating wires 2 are connected in parallel. In one embodiment, the one or more heating wires 2 are connected in serial. The connected heating wires 2 are connected to a power source of the e-cigarette. The heating wire 2 makes direct contact with the internal wall of the air passages. Having more than one air passages increases the heating area, and thus increases the vaporization efficiency.

In order to prevent the e-liquid and the e-liquid vapor from leaking out, the outer wall of the cylindrical ceramic e-liquid conduit 1 is fitted tightly with the main cavity 300. A first air path 41 is formed between a lower seal 4 at a lower end of the first air path 41 and an upper seal 4 at an upper end of the first air path 41. The first air path 41 includes the air intake 31, and vapor path 11, and the air exhaust 32. The air flows through the lower end of the first air path 41, the air intake 31, and one or more air passages inside the vapor path 11, the air exhaust 32, and the upper end of the first air path 41, evenly and smoothly. Each of the seals 4 has a protruded edge 42 along the edge of the seal 4. The protruded edge 42 of the lower seal 4 is placed between the lower end of the vapor path 11 and the air intake 31, and the protruded edge 42 of the upper seal 4 is placed between the upper end of the vapor path 11 and the air exhaust 32, such that the lower seal 4 and the upper seal 4 are tightly fitted with both ends of the vapor path 11.

In order to conveniently assemble and disassemble the heating element assembly 100, the upper end of the ceramic e-liquid conduit 1 has a top cover 5 in cylindrical shape having a lower end and an upper end. The upper end of the top cover 5 has a plug 6 also in cylindrical shape. A second air path 7 is formed in a cylindrical opening at the center of the top cover 5 and the plug 6. The axle of the second air path 7 is aligned with the axle of the first air path 41. The air from the upper end of the first air path 41 flows from the second air path 7 and exits from the heating element assembly 100. A first seal ring 8 is placed on the plug 6. The plug 6 is used to connect an external atomizer to provide vapor for the e-cigarette. The first seal ring 8 enhances the prevention of vapor leakage.

In one embodiment, in order to create a stable structure of the heating element assembly 100, the base 3 connects to the cylinder 301 on the upper end and the metal cover 302 on the lower end. The main cavity 300 is located inside of the cylinder 301. The metal cover 302 is covered with a second seal ring 9. The metal cover 302 has an upper end and a lower end. The metal cover 302 connects to the main cavity 300 through its upper end, and extends downwards from the base 3 through its lower end. The lower end of the metal cover 302 is fitted with an insulation cover 303 from the inside of the metal cover 302, and a metal tube 304 from the inside of the insulation cover 303. The e-liquid intake 33 is located on the side wall of the cylinder 301. The one or more heating wires 2 are electrically connected to the metal cover 302 and the metal tube 304. The metal cover 302 and the metal tube 304 are electrically connected to a positive terminal and a negative terminal of a power source of the e-cigarette, respectively. The insulation cover 303 is used to provide electrical insulation between the metal cover 302 and the metal tube 304. The second seal ring 9 is used to a sealed connection between the metal cover 302 and the body of the e-cigarette.

The ceramic e-liquid conduit 1 is a cylinder. The internal space of the main cavity 300 fits the cylindrical shape of the ceramic e-liquid conduit 1. The air intake 31, the air exhaust 32, and first air path 41 all have the cylindrical openings in the center and the axes of the center space of the air intake 31, the air exhaust 32, and the first air path 41 are aligned with the ceramic e-liquid conduit 1 to allow smooth and even air flow through the heating element assembly 100 from the bottom of the metal cover 302 to the top of the second air path 7.

In another aspect, the present invention relates to an e-cigarette. In certain embodiments as shown in FIGS. 1-4, the e-cigarette includes a heating element assembly 100. The heating element assembly 100 includes: a ceramic e-liquid conduit 1, at least one heating wire 2, a base 3, and a cylinder 301. The ceramic e-liquid conduit 1 is in cylindrical shape with a ceramic wall around to store e-liquid. The ceramic wall around the ceramic e-liquid conduit 1 forms a vapor path 11. The vapor path 11 has an air intake 31 at a lower end of the vapor path 11 and an air exhaust 32 at an upper end of the vapor path 11. The heating wire 2 is wound on and around the internal ceramic wall of the ceramic e-liquid conduit 1. The base 3 has an upper end and a lower end. The cylinder 301 sits on the upper end of the base 3 to form a main cavity 300. The main cavity 300 houses the ceramic e-liquid conduit 1. The cylinder 301 has an e-liquid intake 33 on the side wall of the cylinder 301 to allow e-liquid to flow from an e-liquid storage (not shown in FIGS. 1-4) to the ceramic e-liquid conduit 1. In one embodiment, the e-liquid enters the ceramic e-liquid conduit 1 through the e-liquid intake 33. The e-liquid is then heated by the heating wire 2 to generate vapor. The generated vapor goes up through the air intake 31, the air exhaust 32, and exits the heating element assembly 100 from the upper end of the vapor path 11.

In certain embodiments, the vapor path 11 of the e-cigarette has several air passages. These air passages connect the air intake 31 to the air exhaust 32 in parallel from the lower end of the vapor path 11 to the upper end of the vapor path 11. Each of these air passages has a cylindrical opening from the lower end to the upper end of the vapor path 11. One or more heating wires 2 are wound on each of these air passages and these heating wires 2 are attached to the internal wall of the air passage spirally from the lower end to the upper end of the air passage. In one embodiment, the heating wires 2 for these air passages are connected in serial. In another embodiment, the heating wires 2 for these air passages are connected in parallel.

In certain embodiments, the main cavity 300 of the e-cigarette has a cylindrical opening in the center. The ceramic e-liquid conduit 1 has a cylindrical opening in the center and is fitted tightly inside of the cylindrical opening of the main cavity 300. The ceramic e-liquid conduit 1 is sealed with a lower seal 4 at the air intake 31 and an upper seal 4 at the air exhaust 32. The lower seal 4 has a protruded edge 42 to seal the space between the lower seal 4 and the air intake 31 of the vapor path 11. The upper seal 4 has a protruded edge 42 to seal the space between the upper seal 4 and the air exhaust 32 of the vapor path 11. The cylindrical opening between the lower seal 4 and the upper seal 4 forms a first air path 41.

In certain embodiments, the heating element assembly 100 of the e-cigarette also has: a cylindrical top cover 5, a cylindrical plug 6, and a first seal ring 8. The cylindrical top cover 5 is placed on the upper seal 4 at the air exhaust 32. The cylindrical plug 6 is placed on top of the cylindrical top cover 5. The cylindrical top cover 5 and the cylindrical plug 6 have a center cylindrical opening that forms a second air path 7. The first seal ring 8 is used to seal a connection between the cylindrical plug 6 of the heating element assembly 100 and the e-cigarette.

In certain embodiments, the axes of the air intake 31, the air exhaust 32, and the first air path 41, and the second air path 7, and the ceramic e-liquid conduit 1 are coaxial.

In certain embodiments, the heating element assembly 100 of the e-cigarette also has: a metal cover 302, an insulation cover 303, and a metal tube 304. The metal cover 302 is connected to the lower end of the base 3 and is electrically connected to a first end of the heating wire 2 to form a first electrical terminal to an electrical power supply of the e-cigarette. The insulation cover 303 is placed inside of the metal cover 302. The metal tube 304 is placed inside of the insulation cover 303 and is electrically connected to a second end of the heating wire 2 to form a second electrical terminal to the electrical power supply of the e-cigarette. The metal cover 302 and the metal tube 304 are insulated by the insulation cover 303. The first electrical terminal and the second electrical terminal are connected to the positive terminal and negative terminal of the electrical power supply of the e-cigarette, respectively.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims, the foregoing description and the exemplary embodiments described therein, and accompanying drawings.

What is claimed is:

1. A heating element assembly of an e-cigarette, comprising:

a ceramic e-liquid conduit in cylindrical shape with a ceramic wall around to store e-liquid, wherein the ceramic wall around the ceramic e-liquid conduit forms a vapor path having an air intake at a lower end of the vapor path and an air exhaust at an upper end of the vapor path;

a plurality of heating wires wound on and around the internal ceramic wall of the ceramic e-liquid conduit;

a base having an upper end and a lower end; and a cylinder connected to the upper end of the base to form a main cavity that houses the ceramic e-liquid conduit, wherein the cylinder has an e-liquid intake to allow e-liquid to flow from an e-liquid storage to the ceramic e-liquid conduit, wherein the e-liquid enters the ceramic e-liquid conduit through the e-liquid intake, and the e-liquid is heated by the heating wires to generate e-liquid vapor, and the generated e-liquid vapor goes up through the air intake, the air exhaust, and exits the heating element assembly from the upper end of the vapor path; and wherein the e-liquid comprises flavor concentrate such that the e-liquid vapor generated by heating the e-liquid is a flavored vapor.

2. The heating element assembly of claim 1, wherein the vapor path comprises a plurality of air passages, wherein the plurality of air passages connect the air intake to the air exhaust in parallel from the lower end of the vapor path to the upper end of the vapor path.

3. The heating element assembly of claim 2, wherein each of the plurality of air passages has a cylindrical opening from the lower end to the upper end of the vapor path, and is wound with the heating wires attached to the internal wall of the air passage spirally from the lower end to the upper end of the air passage.

4. The heating element assembly of claim 3, wherein the heating wires for the plurality of the air passages are connected in serial.

5. The heating element assembly of claim 3, wherein the heating wires for the plurality of the air passages are connected in parallel.

6. The heating element assembly of claim 1, wherein the main cavity has a cylindrical opening in the center, the ceramic e-liquid conduit has a cylindrical opening in the center and is fitted tightly inside of the cylindrical opening of the main cavity, and sealed with a lower seal at the air intake and an upper seal at the air exhaust.

7. The heating element assembly of claim 6, wherein the lower seal has a protruded edge to seal the space between the lower seal and the air intake of the vapor path, and the upper seal has a protruded edge to seal the space between the upper seal and the air exhaust of the vapor path, and the cylindrical opening between the lower seal and the upper seal forms a first air path.

8. The heating element assembly of claim 7 further comprising:

a cylindrical top cover placed on the upper seal at the air exhaust;

a cylindrical plug placed on top of the cylindrical top cover, wherein the cylindrical top cover and the cylindrical plug have a center cylindrical opening that forms a second air path; and a first seal ring adapted for sealing a connection between the cylindrical plug 6 of the heating element assemble and the e-cigarette.

9. The heating element assembly of claim 8, wherein the axes of the air intake, the air exhaust, and the first air path, and the second air path, and the ceramic e-liquid conduit are coaxial.

10. The heating element assembly of claim 1 further comprising:

a metal cover connected to the lower end of the base and electrically connected to a first end of each of the heating wires to form a first electrical terminal to an electrical power supply of the e-cigarette;

an insulation cover placed inside of the metal cover; and a metal tube placed inside of the insulation cover connected to a second end of each of the heating wires to form a second electrical terminal to the electrical power supply of the e-cigarette, wherein the metal cover and the metal tube are insulated by the insulation cover, and the first electrical terminal and the second electrical terminal are connected to the positive terminal and negative terminal of the electrical power supply of the e-cigarette, respectively.

11. An e-cigarette comprising a heating element assembly, wherein the heating element assembly comprises:

a ceramic e-liquid conduit in cylindrical shape with a ceramic wall around to store e-liquid, wherein the ceramic wall around the ceramic e-liquid conduit forms a vapor path having an air intake at a lower end of the vapor path and an air exhaust at an upper end of the vapor path;

a plurality of heating wires wound on and around the internal ceramic wall of the ceramic e-liquid conduit;

a base having an upper end and a lower end; and a cylinder connected to the upper end of the base to form a main cavity that houses the ceramic e-liquid conduit, wherein the cylinder has an e-liquid intake to allow e-liquid to flow from an e-liquid storage to the ceramic e-liquid conduit, wherein the e-liquid enters the ceramic e-liquid conduit through the e-liquid intake, and the e-liquid is heated by the heating wires to generate e-liquid vapor, and the generated e-liquid vapor goes up through the air intake, the air exhaust, and exits the heating element assembly from the upper end of the vapor path; and wherein the e-liquid comprises flavor concentrate such that the e-liquid vapor generated by heating the e-liquid is a flavored vapor.

12. The e-cigarette of claim 11, wherein the vapor path comprises a plurality of air passages, wherein the plurality of air passages connect the air intake to the air exhaust in parallel from the lower end of the vapor path to the upper end of the vapor path.

13. The e-cigarette of claim 12, wherein each of the plurality of air passages has a cylindrical opening from the lower end to the upper end of the vapor path, and is wound with the heating wires attached to the internal wall of the air passage spirally from the lower end to the upper end of the air passage.

14. The e-cigarette of claim 13, wherein the heating wires for the plurality of the air passages are connected in serial.

15. The e-cigarette of claim 13, wherein the heating wires for the plurality of the air passages are connected in parallel.

16. The e-cigarette of claim 11, wherein the main cavity has a cylindrical opening in the center, the ceramic e-liquid conduit has a cylindrical opening in the center and is fitted tightly inside of the cylindrical opening of the main cavity, and sealed with a lower seal at the air intake and an upper seal at the air exhaust.

17. The e-cigarette of claim 16, wherein the lower seal has a protruded edge to seal the space between the lower seal and the air intake of the vapor path, and the upper seal has a protruded edge to seal the space between the upper seal and the air exhaust of the vapor path, and the cylindrical opening between the lower seal and the upper seal forms a first air path.

18. The e-cigarette of claim 17 further comprising:

a cylindrical top cover placed on the upper seal at the air exhaust;

a cylindrical plug placed on top of the cylindrical top cover, wherein the cylindrical top cover and the cylindrical plug have a center cylindrical opening that forms a second air path; and a first seal ring adapted for sealing a connection between the cylindrical plug of the heating element assemble and the e-cigarette.

19. The e-cigarette of claim 18, wherein the axes of the air intake, the air exhaust, and the first air path, and the second air path, and the ceramic e-liquid conduit are coaxial.

20. The e-cigarette of claim 11 further comprising:

a metal cover connected to the lower end of the base and electrically connected to a first end of each of the heating wires to form a first electrical terminal to an electrical power supply of the e-cigarette;

an insulation cover placed inside of the metal cover; and a metal tube placed inside of the insulation cover connected to a second end of each of the heating wires to form a second electrical terminal to the electrical power supply of the e-cigarette, wherein the metal cover and the metal tube are insulated by the insulation cover, and the first electrical terminal and the second electrical terminal are connected to the positive terminal and negative terminal of the electrical power supply of the e-cigarette, respectively.

* * * * *